US008393188B2

(12) United States Patent
Hagleitner

(10) Patent No.: US 8,393,188 B2
(45) Date of Patent: Mar. 12, 2013

(54) SANITARY DISPENSER

(76) Inventor: Hans Georg Hagleitner, Zell am See (AT)

( * ) Notice: Subject to any disclaimer, the term of this patent is extended or adjusted under 35 U.S.C. 154(b) by 278 days.

(21) Appl. No.: 12/763,625

(22) Filed: Apr. 20, 2010

(65) Prior Publication Data

US 2011/0254415 A1 Oct. 20, 2011

(51) Int. Cl.
*B65D 55/14* (2006.01)

(52) U.S. Cl. ..... 70/169; 70/158; 70/167; 70/166; 70/63; 70/71; 70/387

(58) Field of Classification Search ..... 70/158–173, 70/63, 71, 387, 345; 312/294; 292/32, 37, 292/38, 42, 137, 159, 169, 140, 145, DIG. 11
See application file for complete search history.

(56) References Cited

U.S. PATENT DOCUMENTS

| | | | | | |
|---|---|---|---|---|---|
| 530,862 | A * | 12/1894 | Teed | 292/42 |
| 1,849,746 | A * | 3/1932 | Jespersen | 70/173 |
| 3,759,075 | A * | 9/1973 | Lipschutz | 70/159 |
| 4,547,006 | A * | 10/1985 | Castanier | 70/71 |
| 5,052,199 | A * | 10/1991 | Derman | 70/58 |
| 5,117,661 | A * | 6/1992 | Carl et al. | 70/14 |
| 7,048,311 | B2 * | 5/2006 | Sawatani et al. | 292/33 |
| 7,156,440 | B2 * | 1/2007 | Katagiri | 296/37.12 |
| 7,182,373 | B2 * | 2/2007 | Yamada | 292/32 |
| 7,823,425 | B2 * | 11/2010 | Crossley | 70/80 |
| 8,051,688 | B2 * | 11/2011 | Soma | 70/162 |
| 8,070,193 | B2 * | 12/2011 | Wang | 292/99 |
| 8,104,800 | B2 * | 1/2012 | Lorek | 292/108 |
| 2006/0055196 | A1 * | 3/2006 | Yamada | 296/37.12 |
| 2006/0261599 | A1 * | 11/2006 | Ikemoto | 292/121 |
| 2007/0180873 | A1 * | 8/2007 | Yen et al. | 70/63 |
| 2008/0022730 | A1 * | 1/2008 | Dietrich et al. | 70/158 |
| 2008/0110893 | A1 * | 5/2008 | Cowie et al. | 220/324 |

* cited by examiner

*Primary Examiner* — Christopher Boswell
*Assistant Examiner* — David E Sosnowski
(74) *Attorney, Agent, or Firm* — Laurence A. Greenberg; Werner H. Stemer; Ralph E. Locher

(57) ABSTRACT

A sanitary dispenser (1) has a housing (1) having an openable cover (20). A locking mechanism (7) locks the cover (20) laterally to the housing (1) and unlocks it by means of a key (25). The locking mechanism (7) has a push rod assembly (9, 14) having two centrally coupled rods (11, 16) which can be displaced in opposite directions and each of which ends at an insertion opening (6). The insertion of the key (25) on either of the two sides (4) of the housing in each case displaces both rods (11, 16).

14 Claims, 3 Drawing Sheets

SANITARY DISPENSER

BACKGROUND OF THE INVENTION

Field of the Invention

The invention relates to a sanitary dispenser having a lockable housing that has an opening on both sides for inserting a key, having an openable cover and having a locking mechanism which latches the cover laterally to the housing and unlatches it by means of the key, which can be inserted on both sides. Examples of such sanitary dispensers are dispensers for toilet paper, kitchen rolls, towel rolls, soap, foam soap, shower gel, cosmetics, disinfectants or the like, and these dispensers are known in many different embodiments.

The locked cover is advantageous in particular in public or even semi-public areas, in order to prevent unauthorized or premature removal of the product to be dispensed, and also to enable refilling only by trained personnel. The covers have a front or visible side and, depending on the design of the housing, two or four side parts. The locking mechanism on the inside is accessible via a keyhole through which the key is introduced and which is generally formed on a side part of the housing (to the left or right, or at the top or bottom), in order to be inconspicuous.

A dispenser of this type is usually mounted on the wall or the like and sometimes the keyhole is difficult to access owing to the space conditions. It is therefore also already known to actuate the locking mechanism from sides of the housing that are opposite one another on the left and the right, keyholes being provided on both sides so that the key can be inserted on the more readily accessible side. A shaft passing across the width of the housing and having a hook at the end can be rotated by means of the key. For space-related reasons, however, it may also be relatively difficult or awkward to rotate the key.

BRIEF SUMMARY OF THE INVENTION

As an alternative, then, the invention proposes an embodiment in which the locking mechanism has a push rod assembly having two centrally coupled rods which can be displaced in opposite directions and each of which ends at an insertion opening, wherein the insertion of the key on either of the two sides of the housing displaces both rods.

The dispenser thus comprises a locking mechanism which is also used under the designation bascule bolt or cremone bolt in particular in windows and doors, wherein the two rods are displaced downwardly and upwardly by means of a central turning handle in order to close the window or the door and are pulled toward one another in order to open the window. However, the actuation of the locking mechanism does not correspond to that for opening and closing a window because a central turning handle cannot be provided; rather, the end of one of the two rods is acted on by the key and the other rod is moved in the opposite direction via the central transmission part.

Depending on the stability of the cover, one or two bolt positions are provided. If the cover is at least largely torsionally rigid, for example trough-like, it may be sufficient to have a locking means which can be assigned either to one of the two rods or, if appropriate, also to the central transmission part. If said locking means is at the end of one rod, it is possible to assign a hook which acts, for example, on the cover, is displaced with the rod when the key is inserted, and releases the cover. The central transmission part could be used to actuate a pivoting bolt which catches for example on the center of the lower or upper edge.

In a preferred embodiment, which is suitable in particular for covers with little torsional rigidity, the locking mechanism has in each case one hook acting on the cover at the end of both rods. In this embodiment, both hooks are released from the cover when the key is inserted, because they move along with the rods.

In a further preferred embodiment, the locking mechanism according to the invention comprises two push rod assemblies which are arranged in a cross-wise or laterally inverted manner, but nevertheless parallel to one another. The two central transmission parts lie coaxially on one another and interact with two by two rods that can be displaced parallel to one another. The ends of said rods lie in pairs next to or above one another, with a small spacing between them, in each case on one of the sides of the housing. In this embodiment, each push rod assembly is provided with just one hook, which acts on the cover at opposing points. Preferably, the side parts of the cover have tabs, behind which the hooks engage. When the key is inserted, the hooks are moved out of the way of the tabs or pulled back when the cover is opened.

The embodiment with two push rod assemblies is better safeguarded against unauthorized opening, since the key must be appropriate for displacing two rods parallel to one another, specifically in each case one rod of the two push rod assemblies, of which one is provided with the hook. It is therefore preferably further provided that each insertion opening has two holes, the spacing of which corresponds to the spacing between the rods of the two push rod assemblies, the key, in the manner of a fork, then having at least two pins corresponding to the holes.

In principle, it is possible to leave the key inserted and only remove it after the cover has been reclosed, the hooks then being taken along and locking the cover. Preference is given, however, to an embodiment in which the rods are displaced counter to the force of a spring when the key is inserted.

An exemplary embodiment of the invention will be described in more detail in the following text with reference to the figures of the accompanying drawing, in which:

DESCRIPTION OF THE INVENTION

Figure 1:
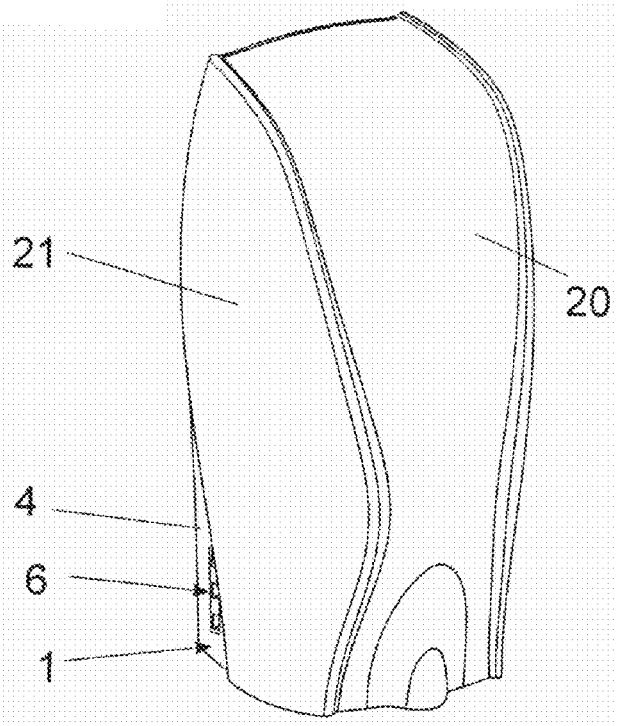
FIG. 1 shows a closed dispenser, for instance for dispensing soap.
Figure 4:
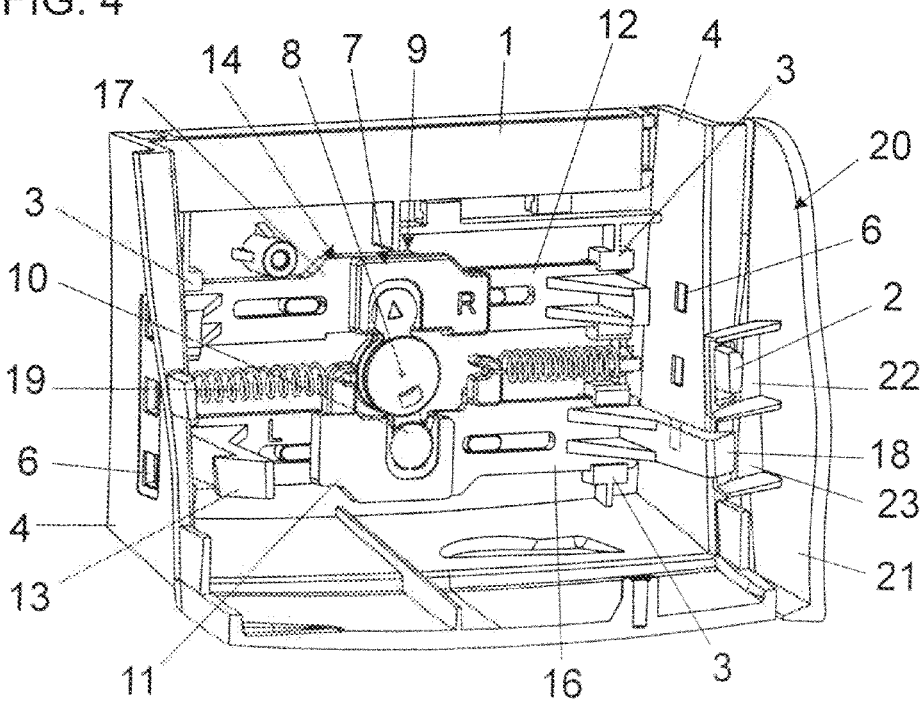
FIG. 4 shows a view as per FIG. 2, in which only one push rod assembly is depicted as being displaced.
Figure 5:
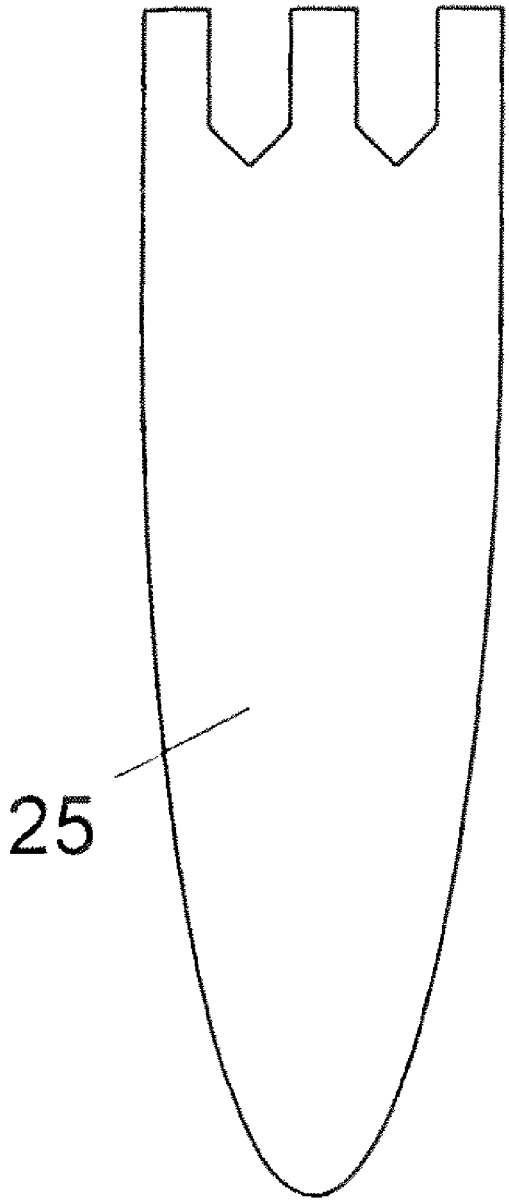
FIG. 5 shows a key depicted in a size appropriate for matching FIGS. 2 to 4.

FIG. 1 shows an oblique view of a closed sanitary dispenser, for example for liquid or cream-like materials, a large part of the housing 1 of which is hidden behind a cover 20, which can be pivoted, for example, upward. An insertion opening 6, which has three holes and into which the key 25 shown in FIG. 5 can be inserted in order to unlock the cover 20, can be seen in the lower region of the side 4 of the housing. As FIGS. 2 to 4 show, an insertion opening 6 is also provided on the other side 4 of the housing, and, depending on the space conditions, the key 25 can be inserted where access to the housing 1 is simpler or easier to achieve.

Inside the housing 1, a locking mechanism 7 can be actuated by insertion of the key 25, and it has two basically approximately Z-shaped push rod assemblies 9, 14, which are mounted on the same axis 8 in a mirror image or laterally inverted manner and each of which has a central transmission part that can be rotated about the axis 8 and has diametrically opposed extensions 10 which engage in rods 11, 12 and 16, 17 that are mounted displaceably in sliding guides 3 of the housing 1. The rods 11, 12, 16, 17 end, in each case at the side 4 of the housing, in the region of a hole of the insertion opening 6, so that when the key 25 is inserted they are displaced inwardly. The lower rods 11 and 16 of the two push rod assemblies 9, 14 each have an end hook 18 and a spring 19.

Figure 2:
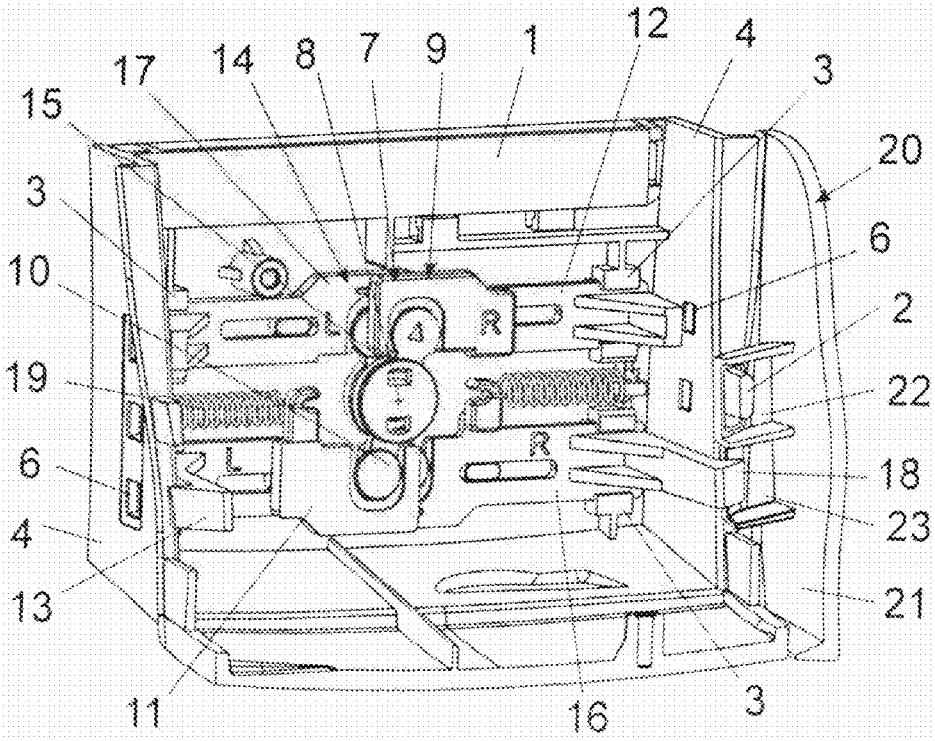
FIG. 2 shows the lower region of the dispenser, wherein the closed cover is shown only in terms of its side-part region, which is necessary for understanding.

FIG. 2 shows the locking position, in which the hooks 18 engage, on both sides 4 of the housing, behind a tab, which protrudes inwardly from a side part 21 of the cover 20. A protrusion 2, which protrudes through an eyelet 22 of the cover 20, is arranged on the housing 1 above the tab 23, so that the side part 21 of the cover 20 cannot be pushed laterally outward.

Figure 3:
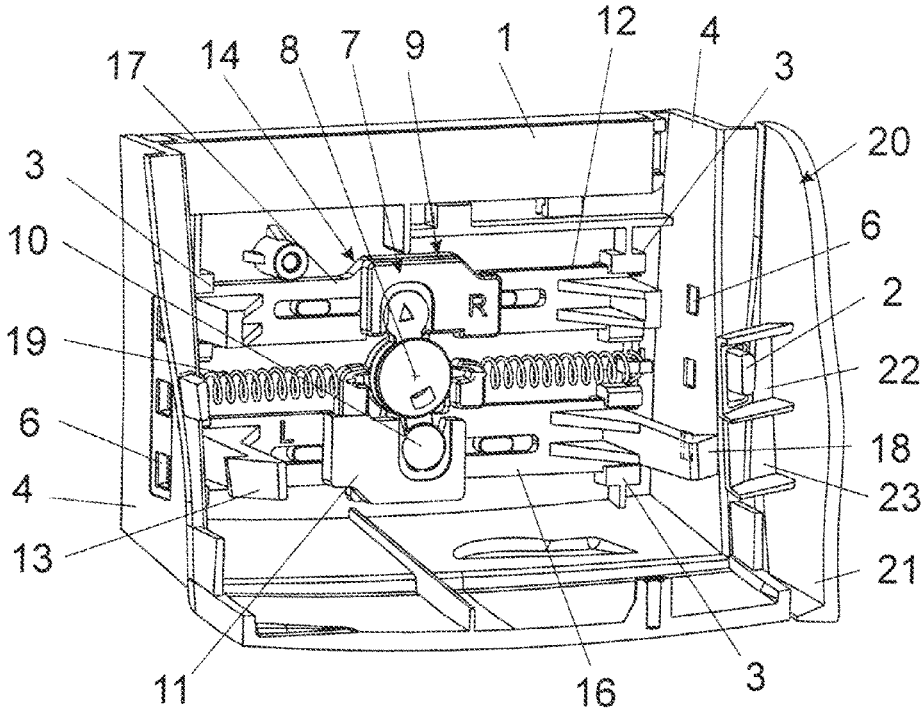
FIG. 3 shows a view as per FIG. 2, in which the cover is unlocked and can be opened.

FIG. 3 shows the unlocked position, which can be achieved by insertion of the key 25 from either side 4 of the housing. The two outer pins of the keys 25 here displace in each case one rod 11 and 17, when the key is inserted from the left, or displace one rod 12 and 16 of each of the two push rod assemblies 9, 14, when the key is inserted through the insertion opening 6 from the right. In both cases, the respectively other rod of each push rod assembly 9, 14 is pulled back, so that the hooks 18, which are provided in each case only on the lower rod 11, 16, release the two tabs 23. The cover 20 can be pivoted up, in which case the eyelets 22 are pulled off the protrusions 2.

FIG. 4 shows a position in which an attempt is being made to insert an inappropriate key on the left-hand side 4 of the housing in order to open the cover 20, wherein said key has only one pin for the bottom-most hole, and possibly a second pin for the functionless central hole, of the insertion opening 6. Although a wrong key of this type displaces the lower rod 11 with the hook 13 and the upper rod 12 of the push rod assembly 9, it does not displace the rods 16, 17 of the second push rod assembly 14. Likewise, if this key were inserted in an inverted manner from the left-hand side 4 of the housing, it would release only the rods 16, 17 of the second push rod assembly 14, and the hook 18 thereof, but not the first push rod assembly 9. The same applies if the wrong key is inserted from the right, since there too, rather than displacing both push rod assemblies 9, 14, it displaces only one, and hence also only one of the two hooks 13, 18, regardless of whether it is inserted through the upper hole or the covered lower hole of the insertion opening 6 on the right-hand side.

The invention claimed is:

1. A sanitary dispenser, comprising:

a lockable housing having two sides, each of said two sides being formed with a respective separate and distinct insertion opening for insertion of a key;

an openable cover mounted to said housing; and a locking mechanism for laterally locking said cover to said housing and being operable for unlocking said cover by way of the key inserted on either side, said locking mechanism including a push rod assembly with two centrally coupled rods displaceably mounted in opposite directions and each terminating at a respective said insertion opening, wherein the insertion of the key on either of the two sides of said housing displaces said two rods.

2. The sanitary dispenser according to claim 1, wherein said locking mechanism includes a hook engaging said cover at an end of one of said two rods.

3. The sanitary dispenser according to claim 1, wherein said locking mechanism includes a respective hook at one end of both rods the respective hook engaging said cover.

4. The sanitary dispenser according to claim 3, wherein each hook engages behind a tab on a side part of said cover.

5. The sanitary dispenser according to claim 1, wherein said locking mechanism has two laterally inverted push rod assemblies, and a hook, that acts on said cover, is disposed at an end of each respective rod of said push rod assembly.

6. The sanitary dispenser according to claim 5, wherein each of said respective insertion openings has two holes, and a spacing of said holes corresponds to a spacing between said rods of said two push rod assemblies.

7. The sanitary dispenser according to claim 1, wherein said rods are displaced counter to a force of a spring when the key is inserted.

8. A sanitary dispenser, comprising:

a lockable housing having two sides, each of said two sides having sidewalls being formed with a respective insertion opening for insertion of a key;

an openable cover mounted to said housing; and a locking mechanism for laterally locking said cover to said housing and being operable for unlocking said cover by way of the key inserted on either side, said locking mechanism including a push rod assembly with two centrally coupled rods displaceably mounted in opposite directions and each terminating at a respective said insertion opening, wherein the insertion of the key on either of the two sides of said housing displaces said two rods.

9. The sanitary dispenser according to claim 8, wherein said locking mechanism includes a hook engaging said cover at an end of one of said two rods.

10. The sanitary dispenser according to claim 8, wherein said locking mechanism includes a respective hook at one end of both rods the respective hook engaging said cover.

11. The sanitary dispenser according to claim 10, wherein each hook engages behind a tab on a side part of said cover.

12. The sanitary dispenser according to claim 8, wherein said locking mechanism has two laterally inverted push rod assemblies, and a hook, that acts on said cover, is disposed at an end of each respective rod of said push rod assembly.

13. The sanitary dispenser according to claim 12, wherein each of said respective insertion openings has two holes, and a spacing of said holes corresponds to a spacing between said rods of said two push rod assemblies.

14. The sanitary dispenser according to claim 8, wherein said rods are displaced counter to a force of a spring when the key is inserted.

* * * * *